US005951817A

United States Patent [19]

Thomas

[11] Patent Number: 5,951,817

[45] Date of Patent: Sep. 14, 1999

[54] SINGLE FACER HAVING AN AUXILIARY NIP

[75] Inventor: Charles E. Thomas, Reisterstown, Md.

[73] Assignee: United Container Machinery, Inc.

[21] Appl. No.: 08/911,592

[22] Filed: Aug. 14, 1997

[51] Int. Cl.[6] ..... B31F 1/28

[52] U.S. Cl. ..... 156/472; 156/470; 156/471

[58] Field of Search ..... 156/210, 470, 156/471, 472; 428/186; 425/373

[56] References Cited

U.S. PATENT DOCUMENTS

| | | | |
|---|---|---|---|
| Re. 24,361 | 9/1957 | Brown . | |
| 545,354 | 8/1895 | Ferres . | |
| 972,121 | 10/1910 | McPike et al. . | |
| 1,519,280 | 12/1924 | Wandel . | |
| 1,609,318 | 12/1926 | Smith . | |
| 2,638,962 | 5/1953 | Nitchie . | |
| 2,720,910 | 10/1955 | Rockstrom et al. . | |
| 2,793,674 | 5/1957 | Reinhard | 156/471 |
| 4,061,222 | 12/1977 | Rushing | 198/807 |
| 4,316,761 | 2/1982 | Hirakawa et al. . | |
| 4,337,884 | 7/1982 | Hirakawa et al. . | |
| 4,481,066 | 11/1984 | Hirakawa et al. . | |
| 4,814,038 | 3/1989 | Hayashi et al. . | |
| 5,110,396 | 5/1992 | Harris . | |
| 5,116,448 | 5/1992 | Murayama et al. . | |
| 5,344,520 | 9/1994 | Seki et al. . | |
| 5,389,183 | 2/1995 | Seki et al. . | |
| 5,449,431 | 9/1995 | Isowa . | |
| 5,512,020 | 4/1996 | Yasui et al. . | |
| 5,518,457 | 5/1996 | Seki et al. . | |
| 5,630,903 | 5/1997 | Knorr et al. . | |
| 5,632,850 | 5/1997 | Knorr et al. . | |
| 5,785,802 | 7/1998 | Seki et al. | 156/471 |

FOREIGN PATENT DOCUMENTS

| | | |
|---|---|---|
| 687552 | 12/1995 | European Pat. Off. . |
| 687553 | 12/1995 | European Pat. Off. . |
| 4413775 | 10/1995 | Germany . |

*Primary Examiner*—Richard Crispino
*Attorney, Agent, or Firm*—Biebel & French

[57] ABSTRACT

A single facer including an auxiliary nip providing an adjustable auxiliary force acting upon a corrugated medium web and a liner web for effective bonding therebetween to form a single faced board is disclosed. An endless belt cooperates with a corrugating roll thereby defining a primary nip. The endless belt is guided over a plurality of belt rolls wherein one of the belt rolls defines an auxiliary nip for providing an auxiliary force pressing the endless belt and the liner web together with the flutes of the medium web. An adjustment means is provided for adjusting the auxiliary force within the auxiliary nip.

22 Claims, 4 Drawing Sheets

10
54
43
48
58
50
90
114
49
44
46
88
42
16
52
86
14
38
35
24
34
32
12
40
34
30
36
22
28
26
29

SINGLE FACER HAVING AN AUXILIARY NIP

BACKGROUND OF THE INVENTION

1. Field of the Invention

The present invention relates to the field of corrugating machinery and, more particularly, to a single facer for the bonding of a corrugated medium web to a liner web to form a single faced board.

2. Description of the Prior Art

A conventional single facer includes an upper corrugating roll and a lower corrugating roll wherein each roll includes a plurality of longitudinally extending teeth. The corrugating rolls are rotatably mounted so that the teeth are disposed in a meshing relationship. A medium web is supplied between the meshing teeth to corrugate flutes therein.

A starch-based glue is applied to the tops of the flutes by a gluing roll, arranged to turn in a bath of glue. Simultaneously, a liner web is fed from a side opposite the medium web over a pressure roll and brought into engagement with glued flutes of the corrugated medium web. A pressure roll as employed in a conventional single facer, is a large diameter metallic roll arranged adjacent the lower corrugating roll to apply a nip pressure to the corrugated web and liner web thereby effecting bonding therebetween.

Bonding of the corrugated medium and liner webs is a direct function of pressing duration and pressing force, wherein pressing duration is directly related to the length of the pressing nip and processing speed of the single facer. If the nip length is decreased while maintaining a constant processing speed then the pressing force must be increased to provide effective bonding. However, if the pressing force is decreased and the processing speed held constant then effective bonding necessitates that the nip length be increased.

Traditional pressure rolls provide a small nip length for acting against the corrugated web and liner web, thereby necessitating a high pressing force. Such high pressing force between the pressure roll and lower corrugating roll typically results in linear press marks, corresponding to the pitch of the teeth of the lower corrugating roll, being formed laterally on the surface of the liner web. The single faced boards produced by the prior art single facers therefore often have an unattractive appearance and are rejected as being defective.

In response, it has been proposed to replace the conventional pressure roll with an endless belt having a portion wrapped about the lower corrugating roll thereby forming an extended nip for pressing the liner web together with the corrugated medium web. More specifically, the endless belt is extended over a plurality of rolls to run freely in cooperation with the lower corrugating roll wherein the liner web and the corrugated medium web pass between the lower corrugating roll and the endless belt and are nipped therebetween.

A common problem associated with the prior art single facers employing an endless belt as described above, is that the belt cannot provide sufficient pressing force given the available nip length, due to machine structure constraints, to provide effective bonding of the liner web and the corrugated medium web. While the tension in the belt may be increased to thereby increase the pressing force, this tension is limited based upon the properties of the belt. Excessive tension in the belt may cause accelerated wear or tearing of the belt.

Accordingly, there remains a need for a single facer providing sufficient pressing force to effectively bond a liner web with a corrugated medium web without damaging the liner web. Further, there is a need for such a single facer providing for a variable auxiliary pressure nip independent of belt tension which may be adjusted in response to variations in web and operating conditions.

SUMMARY OF THE INVENTION

The present invention provides a single facer having primary nip and an auxiliary nip in which the auxiliary nip provides a force acting upon a corrugated medium web and liner web for effective bonding therebetween without damaging the liner web to produce a single faced board.

The single facer of the present invention includes a first corrugating roll in a meshing relationship with a second corrugating roll for corrugating flutes on a medium web. A glue applicator cooperates with the second corrugating roll for applying glue to the flutes of the medium web. An endless belt cooperates with the second corrugating roll and extends along a belt path having opposing ends. A primary nip is defined between the endless belt and the second corrugating roll for providing a primary force pressing a liner web together with the flutes of the medium web. The endless belt is guided over a plurality of rotatably mounted belt rolls comprising a pair of end belt rolls coinciding with the opposing ends of the belt path, one of the end belt rolls defining a nip belt roll. The remaining belt rolls include a tension belt roll and a steering belt roll. The nip belt roll defines an upstream end of the primary nip and cooperates with the second corrugating roll.

An auxiliary nip is defined between the nip belt roll and the second corrugating roll for providing an auxiliary force pressing the endless belt and liner web together with the flutes of the medium web. The auxiliary nip intersects a plane defined by a center axis of the nip belt roll and a center axis of the second corrugating roll.

A nip actuator is operably connected to the nip belt roll for providing an actuator force. An adjustable stop member, supported on the nip belt roll, provides a reaction force opposing the actuator force wherein the auxiliary force is defined by a difference between the actuator force and the reaction force. Adjustment of the stop member adjusts the reaction force and thereby adjusts the auxiliary force between the nip belt roll and the second corrugating roll.

The tension belt roll is located in spaced relation to and downstream from the nip belt roll. A tension actuator is operably connected to the tension belt roll for moving the tension belt roll relative to the nip belt roll thereby adjusting tension in the belt and the primary force of the primary nip.

The steering belt roll is located in spaced relation to the nip belt roll and the tension belt roll. A steering actuator is operably connected to the steering belt roll for pivoting a first end about a second end of the steering belt roll for correcting lateral deviation of the endless belt.

Therefore, it is an object of the present invention to provide a single facer for producing a pressure of such magnitude against a liner web and a corrugated medium web so as to reduce markings on the liner web.

It is yet another object of the invention to provide a single facer which provides an auxiliary nip of variable pressure facilitating optimum bonding of a liner web and a corrugated medium web regardless of variations in paper web specifications and operating conditions.

It is a further object of the invention to provide such an auxiliary nip of variable pressure independent of tension in a belt which defines a primary nip.

Other objects and advantages of the invention will be apparent from the following description, the accompanying drawings and the appended claims.

DETAILED DESCRIPTION OF THE PREFERRED EMBODIMENT

Figure 1:
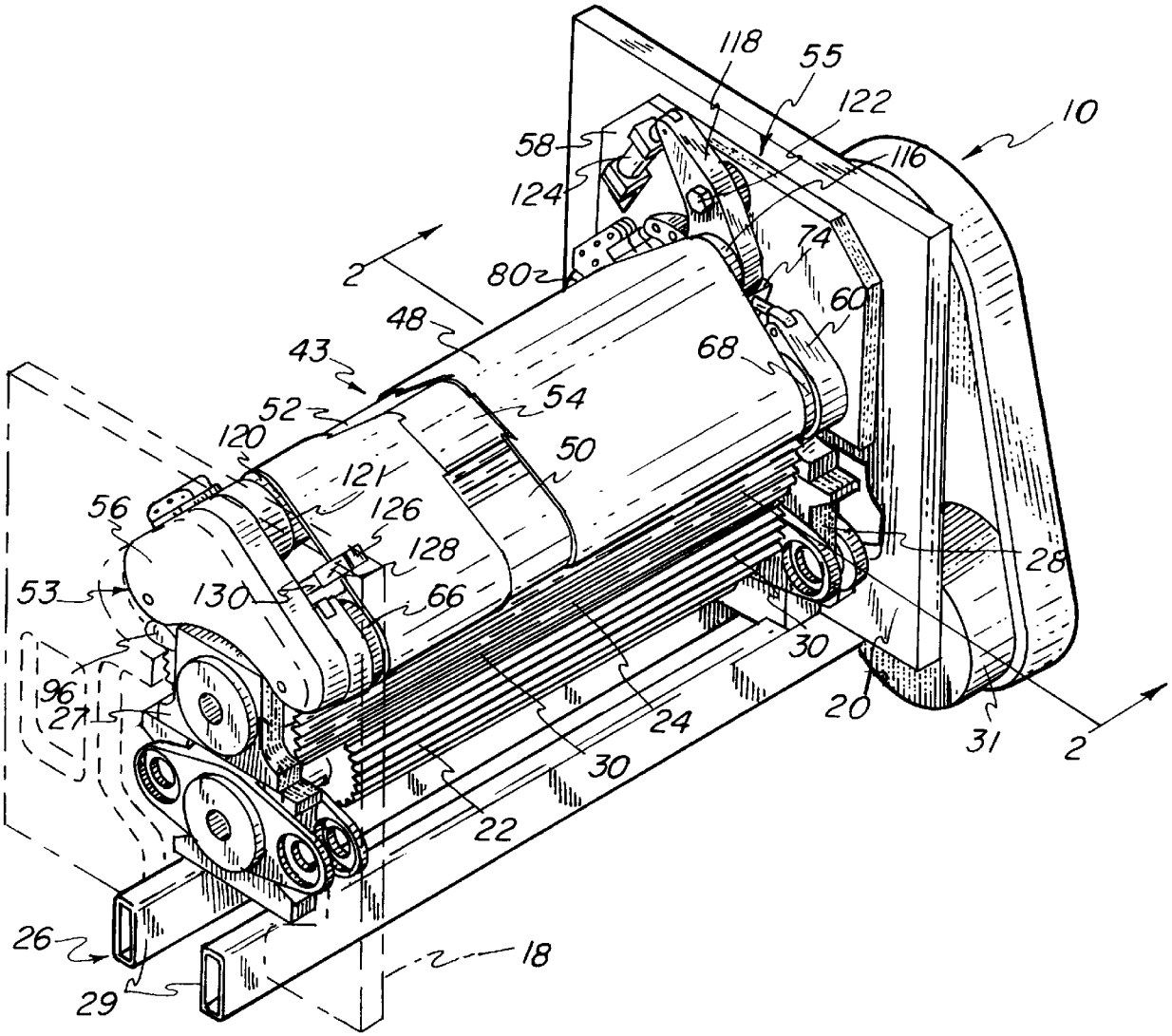
FIG. 1 is a perspective view with a partial cut-away of a single facer of the present invention.
Figure 2:
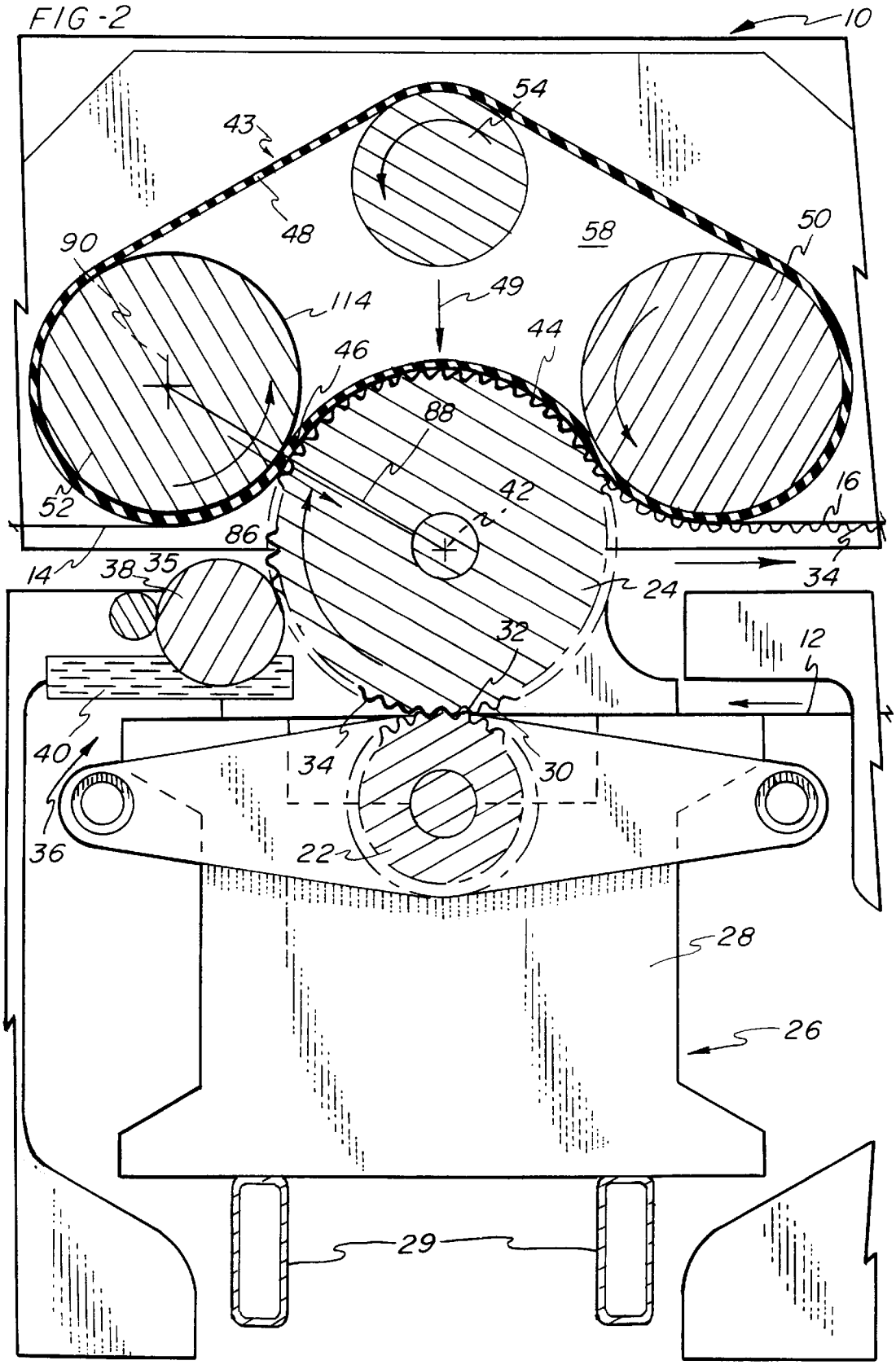
FIG. 2 is a cross-sectional view in partial schematic taken along line 2—2 of FIG. 1.

Referring initially to FIGS. 1 and 2, a single facer 10 constructed in accordance with the preferred embodiment of the present invention is shown. The single facer 10 is adapted for converting a medium web 12 and a liner web 14 into a single faced corrugated cardboard web 16 (FIG. 2).

With further reference to FIG. 1, the single facer 10 includes a pair of opposing fixed frames 18, 20 arranged to be spaced from each other such that frame 18 is on the operator side and frame 20 is on the drive side. A first corrugating roll 22 and a second corrugating roll 24 are rotatably supported between the frames 18, 20 by a movable body 26. The movable body 26 includes movable frames 27 and 28 located on the operator side and the drive side, respectively. The frames 27 and 28 are rigidly mounted on rails 29 which are supported on rollers (not shown). Both first and second corrugating rolls 22 and 24 have teeth 30 formed on their respective circumferences wherein the teeth 30 of the second corrugating roll 24 are designed to be engageable with the teeth 30 of the first corrugating roll 22 via the medium web 12 (FIG. 2). The corrugating rolls 22 and 24 are driven in rotation by a motor 31 adjacent the drive side frame 20.

As seen in FIG. 2, the diameter of the second corrugating roll 24 is preferably greater than the diameter of the first corrugating roll 22. As a result of the relatively large diameter of the second corrugating roll 24, the number of simultaneously meshing teeth 30 of the first and second corrugating rolls 22 and 24 is increased whereby excessive tension in the medium web 12 and subsequent breaking thereof is obviated.

Additionally, the ratio of numbers of teeth 30 between the second corrugating roll 24 and the first corrugating roll 22 is preferably selected to be a predetermined integer ratio. In the event that foreign matter should pass between the teeth 30 of the first and second corrugating rolls 22 and 24, damage to the teeth 30 would be limited to a small number of locations by selecting such an integer ratio. The damage would never propagate to the entire corrugating surface of the rolls 22 and 24 wherein all of the teeth 30 would be deformed or destroyed.

A corrugating nip 32 is defined between the meshing teeth 30 of the first and second corrugating rolls 22 and 24. The corrugating nip 32 pulls the medium web 12 from a web source (not shown), assumed to be on the right hand side of FIG. 2, and forms predetermined flutes 34 within the medium web 12. A glue applicator 36, consisting of a gluing roll 38 rotatably supported to turn in a bath 40 of glue is disposed diagonally below a longitudinal center axis 42 of the second corrugating roll 24. The medium web 12 is glued at its flutes 34 by the glue applicator 36, thereby forming glued flutes 35 which are then diverted upwardly along the circumference of the second corrugating roll 24.

The liner web 14 is pressed into contact with the glued flutes 35 of the medium web 12 to form the single faced webs 16 by a pressing mechanism 43 disposed between the fixed frames 18 and 20 and immediately adjacent the second corrugating roll 24. Contact between the liner web 14 and medium web 12 through the pressing mechanism 43 pulls the liner web 14 from a web source (not shown), which is assumed to be located on the left hand side of FIG. 2. It should be noted that air pressure may be exerted against the medium web 12 between the corrugating nip 32 and the pressing mechanism 43 wherein the medium web 12 is secured against the second corrugating roll 24.

Referring further to FIG. 2, the pressing mechanism 43 includes a primary nip 44 and an auxiliary nip 46. The primary nip 44 is formed by an endless belt 48 cooperating with the second corrugating roll 24 wherein a portion of the belt 48 is held in contact with the liner web 14. A primary pressing force, represented by arrow 49, is a function of the tension within the belt 48 and is generated between the belt 48 and the second corrugating roll 24 for pressing the liner web 14 together with the medium web 12. The belt 48 is wrapped about a plurality of belt rolls 50, 52, 54 for guiding the belt 48 in motion along a belt path having opposing ends. Belt rolls 50 and 52 are end belt rolls coinciding with the opposing ends of the belt path and defining opposing ends of the primary nip 44.

Figure 3:
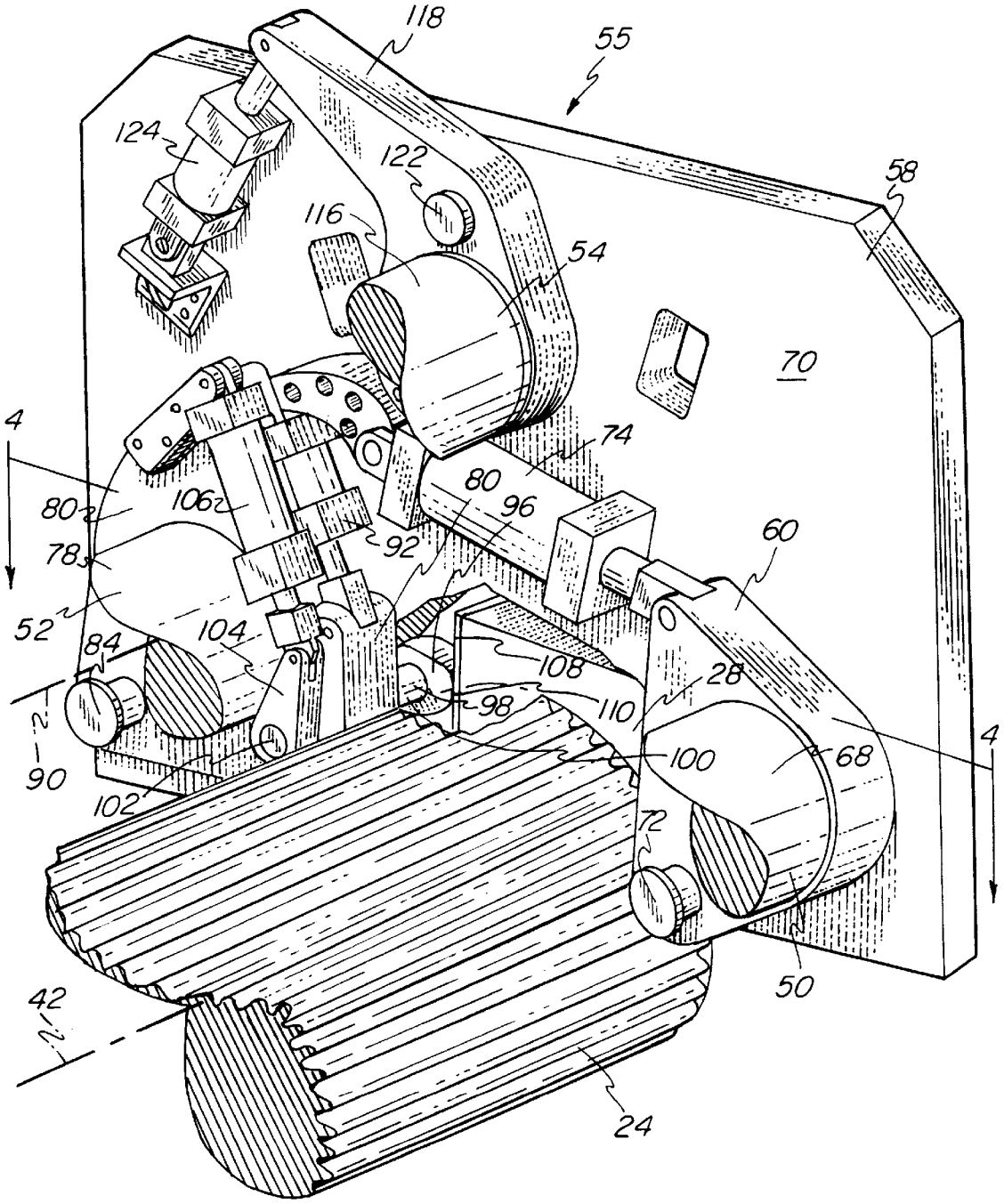
FIG. 3 is a perspective view with a partial cut-away of a drive side belt support assembly of the present invention.

Turning now to FIGS. 1–3, the belt rolls 50, 52, 54 are all rotatably supported by belt support assemblies 53 and 55 including belt support frames 56, 58 which are rigidly mounted between the fixed frames 18, 20. Belt support assembly 53 is located on the operator side while belt support assembly 55 is located on the drive side of the single facer 10.

A tension roll 50 is rotatably supported between the belt support assemblies 53 and 55 in that the tension roll 50 includes first and second ends 66, 68 journaled within tension arms 60. Each tension arm 60 is pivotally mounted to an inside surface 70 of one of the belt support frames 56,58 by a pivot pin 72 (FIG. 3).

A tension actuator, in the form of a hydraulic cylinder 74, is pivotally mounted to the inside surface 70 of each belt support frame 56, 58. The rod of each hydraulic cylinder 74 is pivotally connected to a respective tension arm 60. Accordingly, when the cylinders 74 are actuated, the tension arms 60 are pivoted about pivot point 72, such that the tension roll 50 is moved closer to or further from the other belt rolls 52 and 54, thereby adjusting the tension with the belt 48. Since the primary force 49 is a function of tension in the belt 48, moving the tension roll 50 alters the primary force 49 of the primary nip 44 acting against the liner web 14 and medium web 22. While FIG. 3 illustrates the drive side belt support assembly 55, it is to be understood that the tension roll 50 is identically supported within the operator side belt support assembly 53.

A nip belt roll 52 includes first and second ends 76, 78 journaled for rotational movement within nip roll arms 80. The nip roll arms 80 are each pivotally mounted to the inside surface 70 of the belt support frames 56,58 by a pivot pin 84. Turning again to FIG. 2, the auxiliary nip 46 is defined between the nip belt roll 52 and the second corrugating roll 24 for providing an auxiliary force, represented by arrow 86, therebetween for pressing the liner web 14 together with the medium web 12. The auxiliary nip 46 intersects a plane 88 defined by a center axis 90 of the nip belt roll 52 and the center axis 42 of the second corrugating roll 24.

Figure 4:
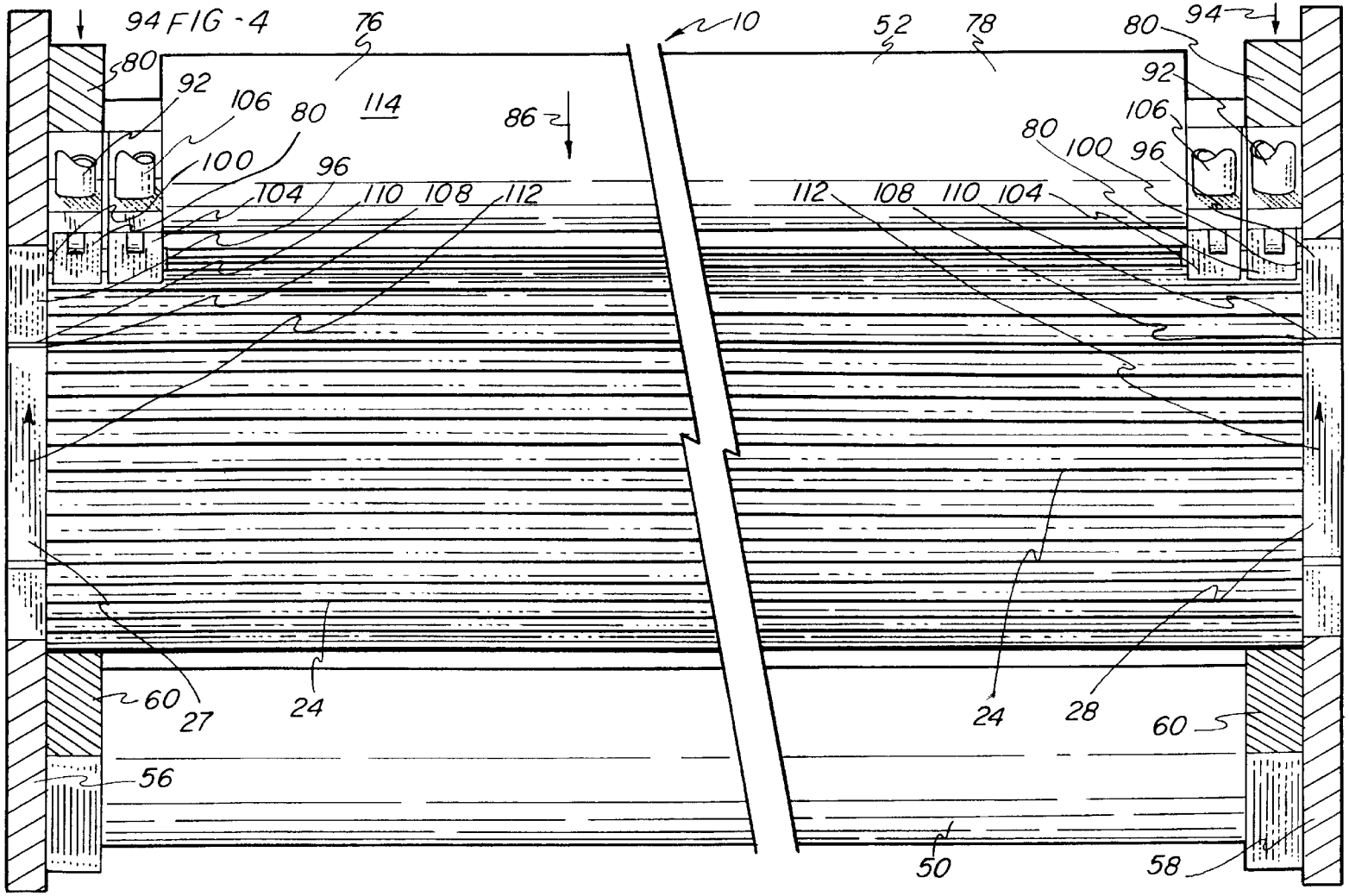
FIG. 4 is a cross-sectional view in partial schematic taken along line 4—4 of FIG. 3 illustrating the forces proximate the auxiliary nip of the single facer of the present invention.

Referring again to FIG. 3, a nip actuator, preferably a hydraulic cylinder 92, is pivotally mounted to the inside surface 70 of each belt support frame 56,58. The rod of each hydraulic cylinder 92 is connected to one of the nip arms 80 for providing an actuator force, represented schematically as arrows 94 in FIG. 4, to the nip arms 80 and nip belt roll 52.

An adjustable cam stop 96 is rotatably mounted to each nip arm 80. More particularly, each cam stop 96 is fixed to a first end 98 of a shaft 100 which is rotatably supported within each nip arm 80. The second end 102 of the shaft 100 is fixed to a lever arm 104 which is pivotally connected to a stop actuator, preferably a hydraulic cylinder 106. Actuation of the cylinder 106 causes rotation of the lever arm 104 and shaft 100 which, in turn, changes the angular orientation of the cam stop 96. The cam stop 96 is adapted to engage a wear plate 108 at a contact point 110, the plate 108 mounted on frames 27, 28. Again, while FIG. 3 illustrates belt support assembly 55, it is to be understood that the nip belt roll 52 is supported in an identical manner within the opposing belt support assembly 53.

The orientation of the cam stop 96 determines the position of the nip belt roll 52 relative to the second corrugating roll 24 and therefore the resulting auxiliary force 86. More specifically and with further reference to FIG. 4, the actuator forces 94 are opposed by reaction forces, represented by arrows 112, generated by the cam stops 96 contacting the wear plates 108. It may be readily appreciated that the magnitude of the reaction forces 112 is directly dependent upon the angular orientation of the cam stop 96.

The auxiliary force 86 is defined by the difference between the total actuator force 94 and the total reaction force 112. The greater the distance between the shaft 100 and the contact point 110, as defined by the angular orientation of the cam stop 96, then the greater the reaction force 112 and the smaller the auxiliary force 86. Of course, the reverse is also true in that the smaller the distance between the shaft 100 and contact point 110, then the smaller the reaction force 112 and the greater the auxiliary force 86.

The required auxiliary force 86 is a function of web characteristics and operating conditions. In the preferred embodiment, each hydraulic cylinder 106 contains an internal linear resistive transducer (LRT). The LRT is coupled with a hydraulic proportional control valve (not shown) to define a feedback system to maintain a constant cylinder rod extension and therefore constant orientation of the cam stop 96. The fixed position of the cam stop 96 results in a substantially consistent auxiliary force 86 being applied to the liner web 14 and medium web 12 at the auxiliary nip 46.

It is preferred that the outer surface of the nip belt roll 52 have a resilient coating 114 consisting of ethylene-propylene-diene (EIPDM) elastomeric alloy. The resilient coating 114 facilitates uniform distribution of the auxiliary force 86 against the liner web 14 and medium web 12.

Referring again to FIGS. 1–3, a steering belt roll 54 is rotatably supported between the belt support assemblies 53 and 55 in spaced relation to the tension belt roll 50 and nip belt roll 52. A first end 116 is rotatably mounted within a steering arm 118 which, in turn, is pivotally mounted to the inside surface 70 of the drive side belt support frame 58 about a pivot pin 122. A second end 120 is pivotally mounted to the operator side belt support frame 56 through a spherical bearing 121 (FIG. 1) in a manner as is well known in the art.

A steering actuator, preferably a hydraulic cylinder 124, is pivotally mounted to the inside surface 70 of the drive side belt support frame 58. The rod of the hydraulic cylinder 124 is connected to the steering arm 118. When the cylinder 124 is actuated the steering arm 118 rotates about pivot pin 122 such that the first end 116 is pivoted about the second end 120 of the steering roll 54.

Operation of the steering cylinder 124 changes the angular position of the steering roll 54 relative to the belt 48 thereby causing the belt 48 to move in its widthwise direction for correcting any lateral deviation. Deviation of the belt 48 in the widthwise direction may be detected by a widthwise edge detector 126 in a manner as is well known in the art. The detector 126 may comprise a photo cell having a light emitting portion 128 disposed on an opposite surface of the belt 48 as a receiving portion 130, both portions 128 and 130 placed adjacent an edge of the belt 48. Upon detecting a deviation of the edge of the belt 48, the detector 126 relays a signal to a control unit (not shown) which activates the steering cylinder 124 for pivoting the steering roll 54 which thereby moves the belt 48 in the widthwise direction.

Accordingly, it may be appreciated that the present invention provides a single facer for providing a pressure of such magnitude against a liner web and corrugated medium web so as to reduce marking on the liner web thereby producing a single faced board of superior quality. Further, the single facer of the present invention provides a pressing mechanism including both primary and auxiliary nips wherein the force of the auxiliary nip may be simply and efficiently varied to facilitate the optimum bonding of the liner web and the corrugated medium web regardless of variations in paper web specifications and operating conditions.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A single facer comprising:

a corrugating roll adapted for corrugating flutes on a medium web;

a glue applicator cooperating with said corrugating roll for applying glue to the flutes of the medium web:

an endless belt guided along a belt path having opposing ends, said belt cooperating with said corrugating roll;

a plurality of belt rolls over which said belt is wrapped, said plurality of belt rolls including a pair of end belt rolls coinciding with said opposing ends of said belt path, one of said end belt rolls defining a nip belt roll;

a primary nip defined between said endless belt and said corrugating roll for providing a primary force pressing a liner web together with the flutes of the medium web, said primary nip having opposing ends defined by said pair of end belt rolls;

an auxiliary nip defined between said nip belt roll and said corrugating roll for providing an auxiliary force pressing said endless belt and the liner web together with the flutes of the medium web; and an adjustment means for adjusting said nip belt roll and said auxiliary force.

2. The single facer according to claim 1, wherein said nip belt roll defines an upstream end of said primary nip.

3. The single facer according to claim 1, wherein said nip belt roll includes an outer surface and a resilient coating disposed on said outer surface for providing a uniform auxiliary force.

4. The single facer according to claim 1, wherein said auxiliary nip intersects a plane defined by a center axis of said nip belt roll and a center axis of said corrugating roll.

5. The single facer according to claim 1, wherein said adjustment means comprises a nip actuator operably connected to said nip belt roll for providing an actuator force.

6. The single facer according to claim 5, wherein said adjustment means further comprises an adjustable stop member for providing a reaction force opposing said actuator force.

7. The single facer according to claim 6, wherein said adjustable stop member comprises a cam supported on said nip belt roll.

8. The single facer according to claim 6, wherein said nip actuator is operably connected to said adjustable stop member for defining said auxiliary force.

9. The single facer according to claim 8, wherein said stop member is adjustable for positioning of said nip belt roll relative to said corrugating roll.

10. The single facer according to claim 1, wherein said plurality of belt rolls further includes a rotatably mounted tension belt roll for guiding said endless belt, said tension belt roll located in spaced relation to and downstream from said nip belt roll.

11. The single facer according to claim 10 further comprising a tension actuator operably connected to said tension belt roll for moving said tension belt roll relative to said nip belt roll for adjusting tension in said belt, thereby adjusting said primary force.

12. The single facer according to claim 10, wherein said plurality of belt rolls further includes a rotatably mounted steering belt roll for guiding said endless belt, said steering belt roll located in spaced relation to said nip belt roll and said tension belt roll.

13. The single facer according to claim 12 further comprising a steering actuator operably connected to said steering belt roll for pivoting a first end of said steering belt roll about a second end of said steering belt roll thereby correcting lateral deviation of said endless belt.

14. A single facer comprising:

a first corrugating roll;

a second corrugating roll in a meshing relationship with said first corrugating roll for corrugating flutes on a medium web;

a glue applicator cooperating with said corrugating roll for applying glue to the flutes of the medium web:

an endless belt guided along a belt path having opposing ends, said belt cooperating with said second corrugating roll;

a plurality of belt rolls over which said belt is wrapped, said plurality of belt rolls including a pair of end belt rolls coinciding with said opposing ends of said belt path, one of said end belt rolls defining a nip belt roll;

a primary nip defined between said endless belt and said second corrugating roll for providing a primary force pressing a liner web together with said flutes of said medium web, said primary nip including opposing ends defined by said pair of end belt rolls;

an auxiliary nip defined between said nip belt roll and said second corrugating roll for providing an auxiliary force pressing said endless belt and said liner web together with said flutes of said medium web, wherein said auxiliary nip intersects a plane defined by a center axis of said nip belt roll and a center axis of said second corrugating roll;

a nip actuator operably connected to said nip belt roll for providing an actuator force;

an adjustable stop member for providing a reaction force opposing said actuator force; and wherein said nip actuator is operably connected to said adjustable stop member for defining said auxiliary force, and said stop member is adjustable for relative positioning of said nip belt roll relative to said corrugating roll.

15. The single facer according to claim 14, wherein said nip belt roll defines an upstream end of said primary nip.

16. The single facer according to claim 14, wherein said nip belt roll includes a resilient coating for providing a uniform auxiliary force.

17. The single facer according to claim 14, wherein said adjustable stop member comprises a cam supported on said nip belt roll.

18. The single facer according to claim 14, wherein said plurality of belt rolls further includes a tension belt roll for guiding said endless belt, said tension belt roll located in spaced relation to and downstream from said nip belt roll.

19. The single facer according to claim 18 further comprising a tension actuator operably connected to said tension belt roll for moving said tension belt roll relative to said nip belt roll for adjusting tension in said belt, thereby adjusting said primary force.

20. The single facer according to claim 18, wherein said plurality of belt rolls further includes a rotatably mounted steering belt roll for guiding said endless belt, said steering belt roll located in spaced relation to said nip belt roll and said tension belt roll.

21. The single facer according to claim 20 further comprising a steering actuator operably connected to said steering belt roll for pivoting a first end of said steering belt roll about a second end of said steering belt roll thereby correcting lateral deviation of said endless belt.

22. A single facer comprising:

a first corrugating roll;

a second corrugating roll in a meshing relationship with said first corrugating roll for corrugating flutes on a medium web;

a glue applicator cooperating with said second corrugating roll for applying glue to the flutes of the medium web;

an endless belt cooperating with said second corrugating roll;

a primary nip defined between said endless belt and said second corrugating roll for providing a primary force pressing a liner web together with the flutes of the medium web;

a rotatably mounted nip belt roll for guiding said endless belt, said nip belt roll defining an upstream end of said primary nip and cooperating with said second corrugating roll;

an auxiliary nip defined between said nip belt roll and said second corrugating roll for providing an auxiliary force pressing said endless belt and the liner web together with the flutes of the medium web, wherein said auxiliary nip intersects a plane defined by a center axis of said nip belt roll and a center axis of said second corrugating roll;

an nip actuator operably connected to said nip belt roll for providing an actuator force;

a cam supported on said nip belt roll for providing a reaction force opposing said actuator force;

wherein said auxiliary force is defined by a difference between said actuator force and said reaction force, and adjustment of said cam adjusts said reaction force and thereby adjusts said auxiliary force;

a rotatably mounted tension belt roll for guiding said endless belt, said tension belt roll located in spaced relation to and downstream from said nip belt roll;

a tension actuator operably connected to said tension belt roll for moving said tension belt roll relative to said nip belt roll for adjusting tension in said belt, thereby adjusting said primary force;

a rotatably mounted steering belt roll for guiding said endless belt, said steering belt roll located in spaced relation to said nip belt roll and said tension belt roll; and a steering actuator operably connected to said steering belt roll for pivoting a first end of said steering belt roll about a second end of said steering belt roll for correcting lateral deviation of said endless belt.

* * * * *